US008834643B2

(12) United States Patent
Schumann et al.

(10) Patent No.: US 8,834,643 B2
(45) Date of Patent: Sep. 16, 2014

(54) METHOD AND COMPOSITION FOR CLEANING OBJECTS

(75) Inventors: Dirk Schumann, Leipzig (DE); Rainer Surkow, Leipzig (DE)

(73) Assignee: Bubbles and Beyond GmbH, Leipzig (DE)

( * ) Notice: Subject to any disclaimer, the term of this patent is extended or adjusted under 35 U.S.C. 154(b) by 239 days.

(21) Appl. No.: 13/259,536

(22) PCT Filed: Mar. 22, 2010

(86) PCT No.: PCT/EP2010/001774

§ 371 (c)(1),
(2), (4) Date: Dec. 20, 2011

(87) PCT Pub. No.: WO2010/108639

PCT Pub. Date: Sep. 30, 2010

(65) Prior Publication Data

US 2012/0085371 A1 Apr. 12, 2012

(30) Foreign Application Priority Data

Mar. 26, 2009 (DE) ..... 10 2009 014 380

(51) Int. Cl.

| | |
|---|---|
| ***B08B 3/04*** | (2006.01) |
| ***C11D 3/18*** | (2006.01) |
| ***C11D 3/20*** | (2006.01) |
| ***C11D 17/00*** | (2006.01) |
| ***C11D 3/00*** | (2006.01) |
| ***C11D 3/32*** | (2006.01) |
| ***C11D 1/825*** | (2006.01) |
| ***C11D 1/83*** | (2006.01) |

(52) U.S. Cl.

CPC ..... *C11D 17/0021* (2013.01); *C11D 3/18* (2013.01); *C11D 3/2072* (2013.01); *C11D 3/20* (2013.01); *C11D 3/0052* (2013.01); *C11D 3/32* (2013.01); *C11D 1/825* (2013.01); *C11D 3/2093* (2013.01); *C11D 3/201* (2013.01); *C11D 1/83* (2013.01)

USPC ..... 134/26; 134/27; 134/29; 134/36; 134/42; 510/417; 510/469; 510/501; 510/505

(58) Field of Classification Search

CPC ..... B08B 3/00; B08B 3/04; C11D 3/2072; C11D 3/2093; C11D 3/32; C11D 11/0023–11/0052; C11D 3/2041; C11D 3/2044; C11D 3/2048; C11D 11/0058; C11D 3/3472; C11D 3/365

USPC ..... 510/417, 469, 501, 505; 134/26, 27, 29, 134/36, 42

See application file for complete search history.

(56) References Cited

U.S. PATENT DOCUMENTS

| | | | | |
|---|---|---|---|---|
| 2,774,740 | A | 12/1956 | Magram | |
| 4,606,840 | A * | 8/1986 | Gautier et al. | 510/417 |
| 5,098,592 | A | 3/1992 | Narayanan et al. | |
| 5,451,405 | A | 9/1995 | Zhang et al. | |
| 5,533,539 | A | 7/1996 | Sutter | |
| 5,691,289 | A | 11/1997 | Purcell et al. | |
| 5,952,287 | A | 9/1999 | Gross et al. | |
| 6,057,279 | A | 5/2000 | Mertens et al. | |
| 6,071,867 | A | 6/2000 | Purcell et al. | |
| 6,432,622 | B1 | 8/2002 | Moon et al. | |
| 2002/0010104 | A1 | 1/2002 | Ewbank et al. | |
| 2002/0032134 | A1 | 3/2002 | Cauwet-Martin | |
| 2005/0130869 | A1 | 6/2005 | Gross et al. | |
| 2006/0165739 | A1 | 7/2006 | Komesvarakul et al. | |
| 2011/0229424 | A1 * | 9/2011 | Schumann et al. | 424/62 |

FOREIGN PATENT DOCUMENTS

| | | |
|---|---|---|
| DE | 830 094 | 1/1952 |
| DE | 1 089 515 | 9/1960 |
| DE | 1 236 704 | 3/1967 |
| DE | 100 49 831 A1 | 8/2001 |
| DE | 695 21 333 T2 | 10/2001 |
| DE | 10 2004 012 751 A1 | 10/2005 |
| DE | 10 2004 015 092 A1 | 10/2005 |
| DE | 10 2004 015 182 A1 | 11/2005 |
| EP | 0496899 B1 | 3/1992 |
| EP | 0 551 378 B1 | 7/1993 |
| EP | 0638296 A1 | 2/1995 |

a b

| | | | |
|---|---|---|---|
| EP | 1 063 283 | A1 | 12/2000 |
| EP | 1 770 446 | A1 | 4/2007 |
| EP | 1 772 496 | A1 | 4/2007 |
| EP | 2045320 | A1 | 4/2009 |
| FR | 2 438 078 | | 4/1980 |
| GB | 1 317 773 | | 5/1973 |
| GB | 2 033 421 | A | 5/1980 |
| GB | 2 190 681 | | 11/1987 |
| WO | WO 91/00337 | | 1/1991 |
| WO | 9207058 | A1 | 4/1992 |
| WO | 9614382 | A1 | 5/1996 |
| WO | 9822087 | A1 | 5/1998 |
| WO | WO 99/06520 | A1 | 2/1999 |
| WO | 2007133934 | A1 | 11/2007 |
| WO | 2008045734 | A2 | 4/2008 |

OTHER PUBLICATIONS

M. Kahlweit et al. "How to Study Microemulsions", *J. Colloid Interf. Sci.*, 118 (2), 436-453 (1987).

Microemulsions, T. Sottmann and R. Strey in *Fundamentals of Interface and Colloid Science*, vol. V, edited by J. Lyklema, Academic Press (2005).

International Search Report issued in PCT/EP2010/001774 filed Mar. 22, 2010, mailed Oct. 6, 2010.

Technical Rules for Hazardous Substances, "Substitute Substances, Substitute Processes and Restrictions on the Use of Methylene Chloride-Based Paint Strippers," TRGS 612 Version: Feb. 2006, pp. 1-12.

* cited by examiner

*Primary Examiner* — Bibi Carrillo
(74) *Attorney, Agent, or Firm* — RatnerPrestia

(57) ABSTRACT

A method for cleaning objects made of organic or inorganic materials, wherein the relevant material is brought into contact with a composition in the form of a fluid nanophase system, comprising a) at least one water-insoluble substance having a water solubility of less than 4 grams per liter, b) at least one amphiphilic substance (NP-MCA) which has no surfactant structure, is not structure-forming on its own, the solubility of which in water or oil ranges between 4 g and 1000 g per liter and which does not preferably accumulate at the oil-water interface, c) at least one anionic, cationic, amphoteric and/or non-ionic surfactant, d) at least one polar protic solvent, in particular having hydroxy functionality, e) if necessary one or more auxiliary substance.

6 Claims, 3 Drawing Sheets a b c a b

METHOD AND COMPOSITION FOR CLEANING OBJECTS

CROSS REFERENCE TO RELATED APPLICATIONS

This application is a U.S. National Phase Application of PCT/EP2010/001774, filed Mar. 22, 2010, which claims priority of German Patent Application No. 10 2009 014 380.7, filed Mar. 26, 2009, the contents of such applications being incorporated by reference herein in their entirety.

FIELD OF THE INVENTION

The present invention relates to a method for cleaning objects made of organic or inorganic materials. In particular, the invention relates to a method the basis of which is that an object that is dirty or to be cleaned is brought into contact with a particular composition until gas or gas bubbles form on the object. In addition, the present invention comprises the use of such compositions and methods for producing them.

BACKGROUND OF THE INVENTION

Since the earliest days of human history, a countless number of methods and agents have developed for the cleaning of objects. Many of them are based on the use of soaps or mechanical agents. The more modern methods utilize the cleaning effect of mainly detergents, surfactants, solvents, heat, water pressure or gas pressure.

A wide variety of methods by which objects for widely differing purposes can be cleaned are known from the state of the art. Most of these cleaning methods are based on a solubilizing, coagulating or aggregating effect of chemical agents, such as in particular solvents, detergents or, often interacting with the chemical agents, on an action of physical, in particular mechanical and/or thermal, forces.

In general, these cleaning methods have the disadvantage that they either pollute the environment, do not function to the desired extent or are to be produced or used in a manner that is elaborate in technical or equipment terms.

For example a method for cleaning objects using an aromatic hydrocarbon of the p-cymene, m-cymene, trimethylbenzene or ethyl toluene type followed by steam distillation to evaporate a formed azeotrope was proposed in WO 92/07058. Aside from the fact that the method cannot be used for every object of any size, these compounds have the disadvantage that they form explosive mixtures with air and are harmful to health.

EP 0638296 A1 reveals a method for cleaning in particular medical objects, according to which the objects to be cleaned are subjected alternately to a pressurized pulsating cleaning fluid and a pulsating air pressure. This method is also applicable only to a spectrum of objects that is narrowly limited in respect of size and is in addition associated with a specific apparatus.

EP 0496899 B1 (WO 92/03205) relates to a method for cleaning in particular electronic parts using non-aqueous solvents such as perfluorocarbons, hydrocarbons and silicones. The cleaning effect is achieved by treating perfluorocarbon with steam. The disadvantages already demonstrated are also inherent in this method.

The method described in WO 96/14382) is directed towards the cleaning of textile fibres, according to which the textile fibres are brought, at an increased temperature of between 60° C. and close to 100° C., into contact with a carbon dioxide-producing mixture of an aqueous carbonate solution and an acid as well as a quantity of surfactant that is effective for cleaning. A disadvantage here is that it is narrowly limited to the application of textile fibres, requires an energy input in the form of heat and that the different components may be used mixed or separated from each other only before application.

SUMMARY OF THE INVENTION

Therefore, there is still a need for a method for cleaning objects which eliminate the deficiencies of the state of the art.

In general, an object of the invention is to provide methods for cleaning objects which remove the disadvantages underlying the state of the art.

Against the background of the state of the art, an object of the present invention is in particular to indicate a method for cleaning objects which has the advantages of a minimum impact on health and the environment.

A further object of the present invention consists in providing a method for cleaning objects which also does not require expenditure on equipment, engineering or energy production.

Another object of the present invention is to disclose a method for cleaning objects which is also characterized by a high profitability.

In addition, an object of the present invention consists in presenting a method for cleaning objects which also recommends itself by being simple and effective.

Another object of the invention is to name the use of a suitable agent or a suitable composition as well as the compositions themselves which, in a method for cleaning objects, develops the above-described advantageous properties.

Figure 1:
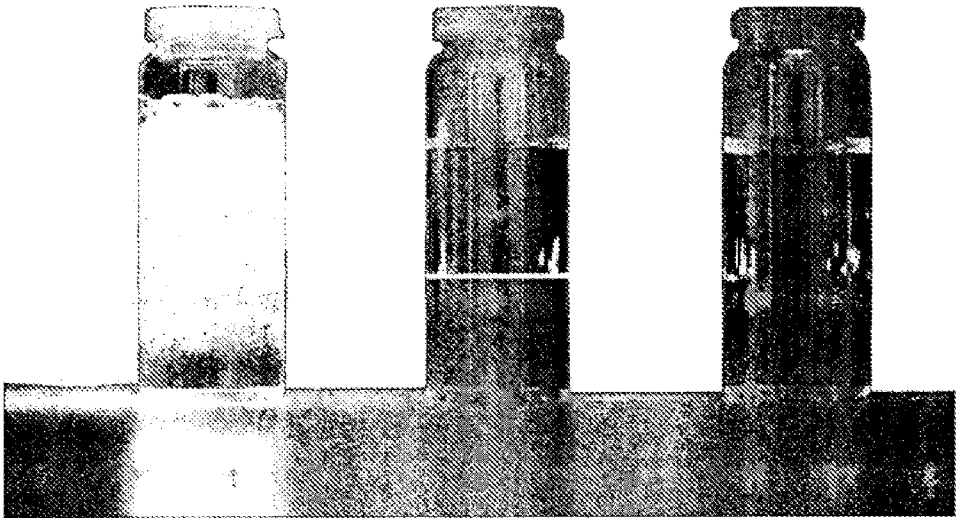
FIG. 1.

Scatter of a green laser beam (Conrad Electronic, Germany, model no. GLP-101, 530-545 nm) to detect the nanostructuring in liquid systems with a) fluid nanophase system according to aspects of the invention of the following composition: water 57.00 wt.-%; oxalic acid dihydrate 0.40 wt.-%; ethyl acetoacetate 13.95 wt.-%; orange oil (ex *Citrus dulcis*) 11.00 wt.-%; $C_{9-11}$ alcohol ethoxylate (4) (Berol 260) 8.85 wt.-%; sodium dodecyl sulphate 8.80 wt.-%; b) water 55.28 wt.-%; 1-methyl-2-pyrrolidone 3.47 wt.-%; ethyl acetoacetate 12.28 wt.-%; orange oil (ex *Citrus dulcis*) 11.35 wt.-%; $C_{9-11}$ alcohol ethoxylate (4) (Berol 260) 8.82 wt.-%; sodium dodecyl sulphate 8.80 wt.-%; c) water. The given percentages by weight are relative to the respective complete composition.

Figure 2:
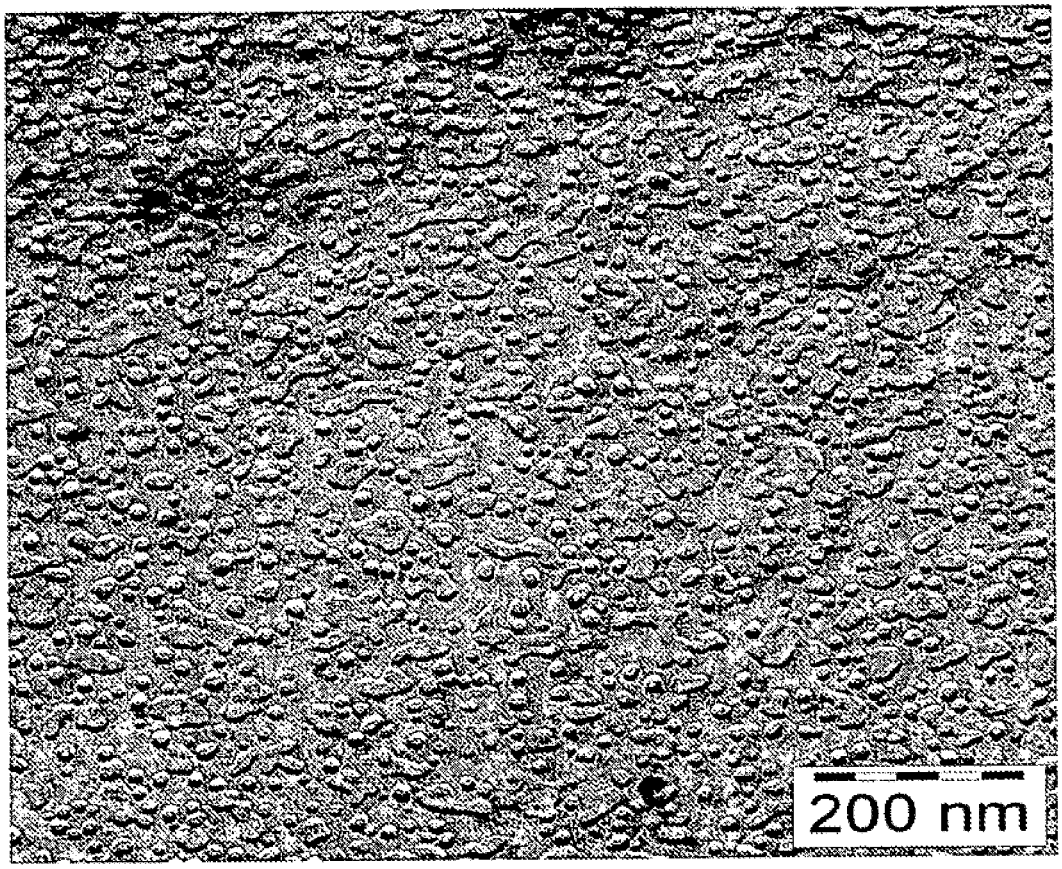

FIG. 2:

FIG. 2 shows, by means of a freezefracture electron microscopy picture, the nanostructure of the fluid nanophase system according to aspects of the invention (the composition aqueous phase: water (55.28 wt.-%); oil phase: orange terpene (11.35 wt.-%); surfactant: sodium dodecyl sulphate (8.80 wt.-%), $C_9$-$C_{11}$ alcohol ethoxylate (4) (8.82 wt.-%); NP-MCA: diacetone alcohol (3.47 wt.-%), ethyl acetoacetate (12.28 wt.-%) (the given percentages by weight are relative to the complete composition). The smaller spherical structures are micelles of the aqueous phase that are approximately 20-50 nm large and are distributed within an oil phase of small structure.

FIG. 3:

Phase diagram (fish diagram or whale diagram) which represents the course of the single-phase and two-phase and lamellar existence ranges of a fluid nanophase system according to aspects of the invention as a function of the surfactant concentration and the temperature. There are shown in a) a composition (water/orange terpene PEG-7 glyceryl cocoate/Berol 260 with a water-orange terpene ratio of 1 and a proportion of 20 wt.-% Berol 260 in the surfactant mixture of PEG-7 glyceryl cocoate/Berol 260) as microemulsion, and in b) the same composition additionally containing 4 wt.-% NP-MCA (ethyl acetoacetate (EAA)) as fluid nanophase system (the given percentages by weight are relative to the complete composition). The temperature range, ΔT, of the single-phase existence range of the cleaning agent is represented, wherein ΔT is determined by the length ascertained in the fish diagram of the tangent parallel to the temperature axis at the Lα field which is limited by the intersections of the tangent with the lower and upper dividing lines between single-phase and two-phase existence range of the cleaning agent. As can be seen from FIG. 3, the presence of NP-MCA results in an enlargement of the temperature range ΔT.

GENERAL DESCRIPTION OF THE INVENTION

According to a first aspect, the objects presented above are achieved according to the subject of claim 1, according to which the surfaces of objects made of organic or inorganic materials can advantageously be cleaned using a method which comprises the steps A) bringing an object made of organic or inorganic materials into contact with a composition in the form of a fluid nanophase system comprising the components
   a) at least one water-insoluble substance with a water solubility of less than 4 grams per liter, in a quantity of from 0.1 to 90 wt.-%,
   b) at least one amphiphilic substance (NP-MCA) which does not have a surfactant structure, is not structure-forming on its own, the solubility of which in water or oil is between 4 g and 1000 g per liter and which preferably does not accumulate at the oil-water interface, in a quantity of from 0.1 to 80 wt.-%,
   c) at least one anionic, cationic, amphoteric and/or non-ionic surfactant; in a quantity of from 0.1 to 45 wt.-%,
   d) at least one polar protic solvent, in particular with hydroxy functionality, in a quantity of between 1.0 and 90 wt.-%,
   e) optionally one or more excipients, in a quantity of from 0.01 to 10 wt.-%, wherein the given percentages are in each case relative to the total weight of the composition,
B) leaving the composition from step A) in contact with the object until gas or gas bubbles form on the object,
C) removing the composition from step A) from the object and
D) optionally then rinsing and/or drying the object treated by steps A) and B).

According to a further aspect, the objects on which the present invention is based are achieved by the use of correspondingly formed gases or gas bubbles for the wet cleaning of surfaces of objects made of organic or inorganic materials in liquids.

A further aspect of the present invention consists in a method for producing gases or gas bubbles which are formed from the aqueous composition according to aspects of the invention, and which are advantageously used for cleaning objects.

Yet another aspect of the present invention is the use of the composition according to aspects of the invention to produce a gas or gas bubbles for the wet cleaning of surfaces of objects made of organic or inorganic materials.

In addition, a further aspect of the present invention consists in the use of a gas or of gas bubbles which are formed from the composition according to aspects of the invention or which can be produced using a method according to aspects of the invention for producing gases or gas bubbles, for the wet cleaning of surfaces of objects made of organic or inorganic materials.

A further aspect of the present invention additionally consists in providing a composition suitable for the methods and uses according to aspects of the invention and corresponding agents.

Unless explicitly stated otherwise, the quantity data given in percent or the percentage data are in each case relative to the total weight of the composition concerned.

DETAILED DESCRIPTION OF THE INVENTION

The present invention comprises a method for cleaning objects, in particular the surfaces thereof, made of organic or inorganic materials characterized by the steps A) bringing an object made of organic or inorganic materials into contact with a composition in the form of a fluid nanophase system comprising the components
   a) at least one water-insoluble substance with a water solubility of less than 4 grams per liter, in a quantity of from 0.1 to 90 wt.-%,
   b) at least one amphiphilic substance (NP-MCA) which does not have a surfactant structure, is not structure-forming on its own, the solubility of which in water or oil is between 4 g and 1000 g per liter and which preferably does not accumulate at the oil-water interface, in a quantity of from 0.1 to 80 wt.-%,
   c) at least one anionic, cationic, amphoteric and/or non-ionic surfactant; in a quantity of from 0.1 to 45 wt.-%,
   d) at least one polar protic solvent, in particular with hydroxy functionality, in a quantity of between 1.0 and 90 wt.-%,
   e) optionally one or more excipients, in a quantity of from 0.01 to 10 wt.-%, wherein the given percentages are in each case relative to the total weight of the composition,
B) leaving the composition from step A) in contact with the object until gas or gas bubbles form on the object,
C) removing the composition from step A) from the object and
D) optionally then rinsing and/or drying the object treated by steps A) and B).

It was in fact surprisingly shown that such a composition allows gases or gas bubbles to form, wherein these gases or gas bubbles advantageously form on dirty surfaces.

This was all the more surprising as these gases or gas bubbles form without heat input, in other words preferably at ambient temperatures of between 0° C. and 55° C., in particular between 5° C. and 50° C., preferably between 10° C. and 45° C., in particular preferably between 15° C. and 40° C., quite preferably between 20° C. and 35° C. and without addition of a further component, in particular one that promotes, produces or helps produce the gas formation.

This was not to be expected from the known state of the art.

Also surprising was the observation that the cleaning effect was caused quite predominantly, if indeed not exclusively, by the small gas bubbles produced from the composition according to aspects of the invention on the object to be cleaned, without further supply of a cleaning agent.

Without being committed to it, the hypothesis is advanced that, for the cleaning effect to occur, the nanophase fluids according to aspects of the invention can penetrate dirt quickly, with the result that this "diffusion-ready" property then makes it possible for gas nanobubbles to form behind the dirt particles. Dirt could be lifted off from the substrate or forced out of pores by further increase in the volume of the small gas bubbles. Gases or small gas bubbles could form through heterogeneous nucleation preferably on microscopically small unevennesses, pores and cavities, in particular at dirty points. It is further supposed, without being committed to it, that microscopically small gas bubbles already produced by the nanophase-structured composition according to aspects of the invention are also enabled to reach under small dirt particles and lift these off from the substrate of the object to be cleaned by further increase in the volume. Quite evidently, the (buoyancy) force formed by these gas bubbles which acts on the dirt particles is greater than the sum of the weight and attachment force or adhesive force of the dirt particle.

If such a mode of operation, even if only theoretical at the moment, should play a part in the cleaning effect, this was also not to be expected.

It was also found that the gas according to aspects of the invention or the gas bubbles are predominantly carbon dioxide, with the result that a gas comprising $CO_2$ is preferred according to aspects of the invention. Aside from this, however, other gases, such as for example hydrogen, nitrogen, oxygen, chlorine, or hydrogen sulphide, nitrogen oxides or ammonia, can also form and are important according to aspects of the invention.

A gas can also advantageously be added to the composition according to aspects of the invention from the outside, which can preferably take place under pressure. Such a gas can comprise for example hydrogen, nitrogen, oxygen, chlorine, nitrogen oxides, ammonia, halogenated hydrocarbons such as for example trichlorotrifluoromethane, dichlorodifluoromethane, 1,1,2,-trichloro-1,2,2-trifluoroethane, 1,2-dichloro-1,1,2,2,-tetrafluoroethane, or hydrogen sulphide or a mixture including at least one of these gases.

Such a gas can be added in a manner known per se, for example in a closed container at room temperature (22° C.) and 2-3 atm ($2\times10^5$-$3\times10^5$ Pa).

In this respect, a composition according to aspects of the invention, such as defined above, which additionally contains a gas added from the outside, is also a subject of the present invention.

The method and the applications of the composition on which the present invention is based produce a range of advantages which principally manifest themselves in a minimal impact on health and the environment, in the absence of a need for expenditure on equipment, engineering and energy production, in a high profitability and by a simple and effective mode of application.

In a preferred embodiment, the composition according to aspects of the invention present as fluid nanophase system can comprise at least one further amphiphilic substance with surfactant structure, for example a cosurfactant with hydrophilic-lipophilic molecular proportions.

Multi-component systems of the water, water-insoluble substance (oil), surfactant and optionally cosurfactant type, which form spontaneously and appear as multi-component systems, are known as microemulsions. Microemulsions are thermodynamically stable, nanostructured fluids which consist at least of water or a watery liquid (e.g. glycerol), oil and a surfactant. Microemulsions sometimes also contain cosurfactants and (when ionic surfactants are used) optionally also salts. The structure sizes of the microemulsions most often lie between 10 and 200 nm. Unlike the kinetically stable emulsions or nanoemulsions, the thermodynamically stable microemulsions tend not to cream due to particle coalescence. In microemulsions, larger structures that have formed briefly decompose again into smaller micelles some time later. As a result, microemulsions form of themselves due to their thermodynamic stability, even without thorough mixing. Unlike emulsions, in microemulsions not only do spherical micelles occur, but also elongated micelles (vermicular micelles) and various forms of network-like structures. In the most favourable case, there is a bicontinuous structure in a microemulsion. Here water phase and oil phase permeate via sponge-like interfaces comprising surfactants and optionally cosurfactants.

Figure 3:
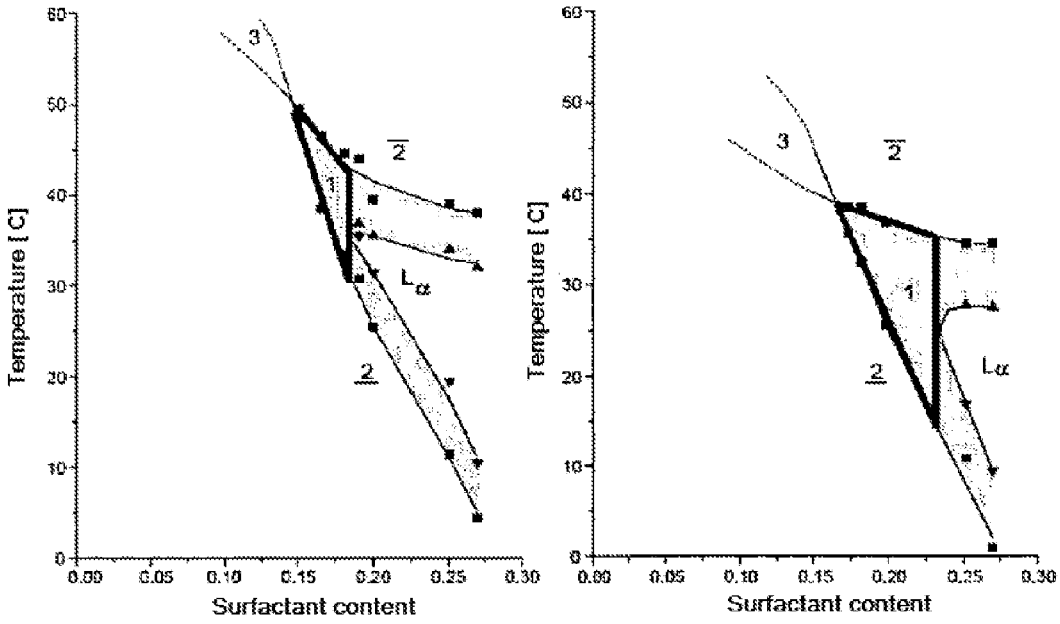

The addition according to aspects of the invention of at least one amphiphilic substance, the so-called NP-MCA (nanophase-forming mixed-chain structure amphiphile), which does not conform to the hydrophilic-hydrophobic structure or properties of surfactant or cosurfactant, makes it possible to advantageously achieve an expansion of the single-phase colloid-disperse area of the microemulsion and to actuate a modification of the properties of the fluid nanophase system, as represented in FIGS. 1 to 3 and described in more detail below.

Surprisingly, it was furthermore ascertained that the addition of NP-MCAs brings about an expansion of the thermodynamically stable, single-phase existence range of the nanostructured systems. This was all the more surprising as the specialists had previously assumed that, the more different the lipophilic and the hydrophilic parts are in respect of their solubility in the respective opposite phase, the more easily microemulsions can form.

Therefore, to produce so-called microemulsions a person skilled in the art used mainly oils and hydrophilic constituents which dissolve in each other as little as possible. Consequently, according to the state of the art, substances which are not surface active and yet remain both in the oil phase and in the hydrophilic phase, as is the case with the non-structure-forming, mixed-chain structure amphiphiles (NP-MCAs) according to aspects of the invention were not used to produce microemulsions.

In this respect, the present invention also overcomes a deep-rooted prejudice among the specialists.

It was furthermore surprising that the addition of NP-MCAs to an oil/water/surfactant mixture allows a clear broadening of the single-phase range of the nanophase fluids that have formed compared with conventional microemulsions to form and, compared with conventional microemulsions, the lamellar phase (La) is largely suppressed in a phase diagram called fish diagram or "whale diagram", with the result that the occurrence of highly viscous lamellar phases in which the oil and water domains are disadvantageously present in layers is prevented or at least reduced (see FIG. 3).

It was also surprising that the addition according to aspects of the invention of an NP-MCA, for example an ethyl acetoacetate, results in a lowering of the temperature window and thus a larger usable temperature range compared with conventional microemulsions (see FIG. 3) can be achieved.

Within the meaning of the present invention, these systems are called fluid nanophase systems (for short: nanophase fluids). Nanophase fluids contain in particular water or a watery substance, oil, at least one structure-forming amphiphile which adsorbs on the oil-water interface and—expanding to the microemulsions—at least one non-structure-forming amphiphile without surfactant structure (NP-MCA). The structure-forming amphiphile is selected from the group consisting of surfactants, cosurfactants or surfactant-like oligomers or polymers.

The NP-MCAs are important for the expansion of the thermodynamically stable existence range of the fluid nanophases and therefore a further delimitation criterion for the microemulsions. The addition of NP-MCAs advantageously makes possible a clear broadening and optionally lowering of the temperature window of the single-phase range.

It is furthermore advantageous that the NP-MCAs can additionally prevent or reduce the occurrence of highly viscous lamellar phases. Additionally, the NP-MCAs can reduce the surfactant concentration that may be necessary.

In addition, it is also advantageous that the NP-MCAs are able to greatly expand the properties and application possibilities of the nanophase fluids for the cleaning.

The group of the nanophase-forming mixed-chain structure amphiphiles (NP-MCAs) comprises mixed-chain structure amphiphiles which have hydrophilic and hydrophobic molecular areas which lie spatially close together but are mixed such that they do not have a surfactant-like structure. They thus differ from surfactants and cosurfactants which obtain their function through the directional separation of the two areas (head-to-tail structure). As a result, NP-MCAs are not capable of forming superlattices on their own and preferably do not accumulate at the oil-water interface. Therefore, besides the oil or water phase, another surfactant is additionally necessary for the formation of nanophase fluids. However, NP-MCAs have a significant solubility in the water phase or oil phase and disperse in the latter until an equilibrium is reached. The solubility of the NP-MCA in water or oil is normally between 4 and 1000 grams per liter, optionally also in the form of its salts.

An NP-MCA according to aspects of the invention comprises an amphiphilic substance which does not have a directional hydrophilic-hydrophobic surfactant structure, is not structure-forming, i.e. not micelle-forming, on its own, the solubility of which in water or oil is between 4 g and 1000 g per liter and which preferably does not accumulate at the oil-water interface.

In microemulsions, a triangle can be stretched between the X-point and the intersection points of the boundary area between the single-phase and the two-phase area and the tangent laid parallel to the Y-axis of the starting La-field in the phase diagram as a function of temperature and surfactant concentration (fish or whale diagram). Measuring methods for constructing the surfactant concentration-temperature phase diagram (fish or whale diagram) are known to a person skilled in the art from the state of the art. NP-MCAs unexpectedly and advantageously result in a broadening of the existence range of the single-phase area, as well as in an enlargement of the surface area of this triangle, and can be defined via this. Preferably all amphiphiles which, if added at 4% to an oil-water-surfactant system, result in an enlargement of the surface area of this triangle by at least 5%, without modifying the surfactant system, preferably by at least 10% and quite particularly preferably by at least 20%, can be used as NP-MCAs. In a particular embodiment, the surface area of the triangle is enlarged in a range of from 5% to 2000%, without modifying the surfactant system, preferably from 10% to 1000%, quite particularly preferably from 15% to 500%.

Particularly preferred are NP-MCAs which are characterized in that, when added to an oil-water-surfactant system containing the constituents oil a), surfactant c) and polar protic solvent d), and optionally excipients e) at 4 wt.-% relative to the total weight of the system, they result in an at least 5% enlargement of the surface area of the triangle contained in the phase diagram which is determined by the three corner points:

i) the X-point, ii) the upper intersection point of the boundary area between the single-phase and the two-phase area with the tangent laid parallel to the temperature Y-axis at the starting La-field and iii) the lower intersection point of the boundary area between the single-phase and the two-phase area with the tangent laid parallel to the temperature Y-axis at the starting La-field.

The position of such triangles is illustrated in FIG. 3.

The methodology for constructing such phase diagrams is described for example in: —M. Kahlweit, R. Strey, D. Haase, H. Kunieda, T. Schmeling, B. Faulhaber, M. Borkovec, H. F. Eicke, G. Busse, F. Eggers, T. Funck, H. Richmann, L. Magid, O. Soderman, P. Stilbs, J. Winkler, A. Dittrich, and W. Jahn: "How to Study Microemulsions", *J. Colloid Interf. Sci.,* 118 (2), 436 (1987)—Microemulsions, T. Sottmann and R. Strey in *Fundamentals of Interface and Colloid Science*, Volume V, edited by J. Lyklema, Academic Press (2005).

In order to obtain a phase diagram (whale diagram) samples are made up with a constant ratio of the non-surfactant components and a surfactant proportion which is increased stepwise starting from 0% up to a desired surfactant proportion (optionally up to 100%). The step increase is based on the demands of measurement precision, wherein a step size of 2% is most often sufficient. These samples are left in a thermostatted medium (preferably water, possibly with freezing-point-lowering additives) at temperatures of from minus (−) 30° C. to plus (+) 100° C. until the phase balance is established, after which the phase state is assessed visually via the light scatter. The size of the temperature steps results from the desired measurement precision, wherein a step size of 1° C. is most often sufficient for technical applications. The phase boundaries result from the transition from one phase state into the next, wherein the error is predetermined by the step size of the temperature measurement. The thus-obtained measurement points are plotted in a diagram and joined up, wherein the temperature is plotted against the surfactant proportion. In most cases it is enough to find the phase states existing in the measurement range in a sample and to determine the phase boundaries via nested intervals. The value for the phase broadening of the nanostructured fluid composition is determined by presenting a triangle in the phase diagram of FIG. 3, in such a way that a first straight line a) is formed starting from the X-point to the curve characterizing the phase state above the average temperature (line above 2), a second straight line b) is formed such that it tangentially touches the aperture angle of La and the first straight line a) intersects at the site of its tangential contact point with the curve characterizing the curve above the average temperature (line above 2), and a third straight line c) is laid on the curve characterizing the phase state below the average temperature (line below 2) such that it cuts the two straight lines a) and b). A numerical value A1 results from totalling the lengths of the three straight lines in FIG. 3, which corresponds to a microemulsion according to the state of the art. The analogous totalling of the lengths of the straight lines of a phase diagram according to aspects of the invention (nanophase fluid) results in a numerical value A2. The numerical value of the advantageous phase broadening achieved by the present invention is ascertained by forming the A2/A1 ratio, thus by dividing A2 by A1. For the composition according to aspects of the invention of the nanophase fluid, this numerical value is greater than 1.0; particularly, greater than 1.1; in particular, greater than 1.15; quite particularly, greater than 1.2; preferably greater than 1.22. The scale of the triangle can be influenced in addition or alternatively to the enlargement of the surface area of the triangle. Preferred NP-MCAs are characterized in that, when added at 4 wt.-% relative to the total weight of the composition a) according to aspects of the invention to an oil-water-surfactant system containing the constituents a1), a3) and a4), they result in an at least 5% enlargement of the temperature range ΔT of the single-phase existence range of the composition a) according to aspects of the invention, which is determined by the length, ascertained in the phase diagram as a function of temperature and surfactant concentration, of the tangent parallel to the temperature axis at the Lα field which is limited by the intersection points of the tangent with the lower and upper dividing lines between single-phase and two-phase existence range of the composition a) according to aspects of the invention (see FIG. 3). Particularly preferred NP-MCAs result in an enlargement of the temperature range ΔT of from 10% to 1000%, quite particularly preferably from 20% to 500%. The temperature range ΔT can be influenced in addition or alternatively to the enlargement of the surface area and/or the scale of the triangle.

By NP-MCAs are meant in particular molecules which consist of carbon, hydrogen and of at least one of the following types of atom (heteroatoms): silicon, oxygen, nitrogen, sulphur, phosphorus, fluorine, chlorine, bromine, iodine. Polar carbon atoms are preferably situated next to heteroatoms. Polar carbon atoms are not to be included in an alkyl chain or non-polar chain.

Preferred NP-MCAs within the meaning of the present invention comprise those that are selected from the group comprising alcohols, ketones, esters, heterocyclic compounds with 5 to 7 atoms per cycle, ethers, amides and amines, N-acylated amino acids, and some aldehydes which do not have a surfactant-like structure, thus do not have a directional head-to-tail structure. These are in particular alcohols (monoalcohols, dialcohols, trialcohols, etc.) which do not have a surfactant-like structure.

Advantageous, and therefore preferred, are those NP-MCA molecules of which the hydrophilic and hydrophobic areas are mixed in the molecule such that:

i) no terminal, non-polar chain which is situated on a primary or secondary carbon atom has 4 or more carbon atoms. Should the chain be longer, it must not account for more than 20% of the molecular weight;

ii) a non-polar chain that is intramolecular or situated on a tertiary carbon atom is not longer than 7 carbon atoms (in other words greater than for example 1,9-nonanediol) and accounts for more than 20% of the molecular weight. Larger chains are capable of remaining in the non-polar area, while the polar portions of the molecule are to be found in the hydrophilic area;

iii) in monocyclic alcohols, the shortest path through the cycle for the determination of the chain length after point i) and ii) is chosen as chain length;

iv) in polycyclic alcohols, only the completely non-polar cycles are taken into account for the determination of the chain length according to point i) and ii) and here the lowest number of carbon atoms is taken as chain length.

Because of the comparable polarity, what was said for alcohols applies analogously to amines and alcohol amines. The same applies analogously to fluorides, chlorides and molecules which are constructed from such groups.

A method with a composition which comprises such non-structure-forming, mixed-chain structure amphiphiles from the group of the alcohols, amines and alcohol amines is also a subject of the present invention.

In particular ketones or acids and their weak salts and amides, as well as organyl sulphates and phosphates, can also be preferred NP-MCAs within the meaning of the present invention. Because of their slightly higher polarity compared with alcohols, a chain length increased by 1 applies here to terminal and intramolecular chains.

Consequently, a method with a composition which comprises such non-structure-forming, mixed-chain structure amphiphiles from the group of the ketones or acids and their weak salts and amides, as well as organyl sulphates and phosphates, is also a subject of the present invention.

Alkyl, alkenyl, alkinyl, aryl sulphides, phosphides and silicones/siloxanes can furthermore also be preferred NP-MCAs within the meaning of the present invention. Because of the lower polarity, a chain length reduced by 1 compared with alcohols applies here.

As a result, a method with a composition which comprises such non-structure-forming, mixed-chain structure amphiphiles with alkyl, alkenyl, alkinyl residues or from the group of the aryl sulphides, phosphides and silicones/siloxanes is also a subject of the present invention.

In addition, in particular NP-MCAs which contain several of the above-named functionalities are also preferred according to aspects of the invention, wherein different functional groups can also occur in the molecule. The chain lengths given in the case of alcohols here serve as chain lengths for delimiting conventional surfactant-like molecules, provided that the functionalities are not predominantly ketones, acids and their weak salts, amides or organyl sulphates or phosphates.

A method using a composition comprising an amphiphilic substance (NP-MCA) selected from the group consisting of alcohols, amines, alcohol amines, ketones, acids and their weak salts and amides, organyl sulphates and phosphates, alkyl, alkenyl, alkinyl residues, from the group of the aryl sulphides, phosphides and silicones/siloxanes is thus a preferred subject of the present invention.

Particularly preferred NP-MCAs are selected from diols of Formula I:

$$R_1R_2COH—(CH_2)_n—COHR_1R_2 \quad \text{[Formula I]}$$

wherein n can be =0, 1, 2, 3 or 4, $R_1$ and $R_2$ are in each case independently of each other hydrogen or an unbranched or branched $C_1$-$C_3$ alkyl.

From this group in particular particularly preferred NP-MCAs are selected from the following diols: 1,3-propanediol, 1,3-butanediol, 1,4-butanediol, 1,5-pentanediol, 1,6-hexanediol, 2,3-butanediol, 2,4-pentanediol, 2-ethyl-1,3-hexanediol, 2,5-dimethyl-2,5-hexanediol, 2-methyl-2,4-pentanediol, 2-(n-butyl)-2-ethyl-1,3-propanediol or from 1,2-diols.

The named diols are suitable in particular for providing a composition according to aspects of the invention for the method according to aspects of the invention and its use according to aspects of the invention.

Particularly preferred NP-MCAs are also selected from acetoacetates of Formula II:

$$C(R_3)_3—CO—CH_2—CO—O—R_4 \quad \text{[Formula II]}$$

wherein in each case independently of each other $R_3$ is hydrogen or a $C_1$ to $C_2$ alkyl and $R_4$ is a branched or unbranched $C_1$ to $C_4$ alkyl;

or from acetoacetates of Formula III:

$$CH_3—CO—CH_2—CO—O—R_5 \quad \text{[Formula III]}$$

wherein $R_5$ is a $C_1$ to $C_4$ alkyl.

From this group in particular particularly preferred NP-MCAs are selected from the following acetoacetates: ethyl acetoacetate, isopropyl acetoacetate, methyl acetoacetate, n-butyl acetoacetate, n-propyl acetoacetate or tert-butyl acetoacetate.

The named acetoacetates are suitable in particular for providing a composition according to aspects of the invention for the method according to aspects of the invention and its use according to aspects of the invention.

Further preferred NP-MCAs are selected from diones of Formula IV $$CH_3—(CH_2)p\text{-}CO—(CH_2)q\text{-}CO—(CH_2)r\text{-}CH_3 \quad \text{[Formula IV]}$$

wherein p, q, r independently of each other can be 0, 1 or 2, with the proviso that, if the sum of p, q and r=2, the compound according to Formula IV can also be cyclic (cyclohexanedione).

From this group in particular particularly preferred NP-MCAs are selected from the following diones: 2,3-butanedione (diacetyl), 2,4-pentanedione (acetylacetone), 3,4-hexanedione, 2,5-hexanedione, 2,3-pentanedione, 2,3-hexanedione, 1,4-cyclohexanedione or 1,3-cyclohexanedione.

The named diones are suitable in particular for providing a composition according to aspects of the invention for the method according to aspects of the invention and its use according to aspects of the invention.

Likewise preferred NP-MCAs are selected from esters of Formula V $$R_6—CO—O—R_7 \quad \text{[Formula V]}$$

wherein $R_6$ is a ring bond to $R_7$, $CH_3$ or $COCH_3$ and $R_7$ is a $(CH_2)_2$—O— ring bond to $R_6$, $(CH_2)_2$—O—$(OH_2)_3$—$CH_3$, $CH_2$—

$CH_3$ or $CH_2$—$CH(CH_3)$—O— ring bond to $R_6$.

From this group in particular particularly preferred NP-MCAs are selected from the following esters: (1-methoxy-2-propyl)-acetate, (2-butoxyethyl)-acetate, ethylene carbonate, ethyl pyruvate (2-oxo propanoic acid ethyl ester) or propylene carbonate.

The named esters are suitable in particular for providing a composition according to aspects of the invention for the method according to aspects of the invention and its use according to aspects of the invention.

Further preferred NP-MCAs are selected from maleic or fumaric acid amides of Formula VI $$R_8—HN—CO—C{=}C—CO—O—R_9 \quad \text{[Formula VI]}$$

wherein $R_8$ is hydrogen, a branched or unbranched $C_1$-$C_4$ alkyl, or a branched or unbranched, linear or cyclic $C_1$-$C_6$ alkyl, wherein the $C_1$-$C_6$ alkyl is substituted by one or more groups selected from OH, $NH_2$, COOH, CO, $SO_3H$, $OP(OH)_2$, and $R_9$ is hydrogen or a branched or unbranched $C_1$-$C_4$ alkyl.

From this group in particular particularly preferred NP-MCAs are selected from the following maleic acid amides and their methyl, ethyl, propyl and butyl esters: N-methylmaleamide; N-ethylmaleamide; N-(n-propyl)-maleamide; N-(i-propyl)-maleamide; N-(n-butyl)-maleamide; N-(i-butylmaleamide); N-(tert-butylmaleamide), as well as the corresponding fumaric acid amides and their methyl, ethyl, propyl and butyl esters.

Further preferred NP-MCAs are selected from: 2,2-dimethoxypropane, pyruvic aldehyde-1,1-dimethyl acetal, diacetane alcohol (2-methyl-2-pentanol-4-one), 2-butanol, 2-acetyl-gamma-butyrolactone, 3-amino-1H-1,2,4-triazole, gamma-butyrolactone, nicotinic acid amide, ascorbic acid, N-acetylamino acids, in particular N-acetylglycine, alanine, cysteine, valine or arginine, triethyl phosphate, n-butyl acetate, dimethyl sulphoxide or 2,2,2-trifluoroethanol.

According to aspects of the invention, the following NP-MCAs are quite particularly preferred, which are selected from the group consisting of ethyl acetoacetate; i-propyl acetoacetate; methyl acetoacetate; methyl isobutyrylacetate (methyl-(4-methyl-3-oxopentanoate)); n-butyl acetoacetate; n-propyl acetoacetate; tert-butyl acetoacetate; allyl acetoacetate; maleic acid amide (maleamic acid, maleamide), the following maleamides and their methyl, ethyl, propyl and butyl esters; N-methylmaleamide; N-ethylmaleamide; N-(n-propyl)-maleamide; N-(i-propyl)-maleamide; N-(n-butyl)-maleamide; N-(i-butylmaleamide); N-(tert-butylmaleamide); as well as the corresponding fumaric acid amides and their methyl, ethyl, propyl and butyl esters; 2,2-dimethoxypropane; diacetone alcohol (4-hydroxy-4-methylpentan-2-one); 1,3-butanediol; 1,4-butanediol; 1,5-pentanediol; 1,6-hexanediol; 2-ethyl-1,3-hexanediol, 2-methyl-2,4-pentanediol, 2-(n-butyl)-2-ethyl-1,3-propanediol; 1,3-propanediol; 2,3-butanediol; 2,4-pentanediol; 2,5-dimethyl-2,5-hexanediol; (1-methoxy-2-propyl)-acetate; (2-butoxyethyl)-acetate; 1,3-cyclohexanedione; 1,4-cyclohexanedione; 2,3-hexanedione; 2,3-pentanedione; 2,5-hexanedione; 3,4-hexanedione; acetylacetone (2,4-pentanedione, ACAC); diacetyl (2,3-butanedione); ethylene carbonate; propylene carbonate; 2-acetyl-gamma-butyrolactone; N-acetylcysteine and methyl, ethyl, propyl, butyl esters; N-acetylglutamic acid and methyl, ethyl, propyl, butyl esters; N-acetylglycine and methyl, ethyl, propyl, butyl esters; N-acetyltyrosine and methyl, ethyl, propyl, butyl esters; N-acetylvaline and methyl, ethyl, propyl, butyl esters; ethylpyruvate (2-oxopropanoic acid ethyl ester); pyruvic aldehyde-1,1-dimethyl acetal; 3-amino-1H-1,2,4-triazole; diethyl-3-oxoglutarate; diethylene glycol diethyl ether; diisopropyl ether; ethylene glycol diethyl ether; methylcarbamate; tert-butyl methyl ether; vinyl acetate; quinine (free base, as hydrochloride); adipic acid diamide; succinic acid imide; N-methylcaprolactam; acetic acid diethylamide; urea; thioacetamide; 1,2-phenylenediamine; 1,3-phenylenediamine; 1,4-diaminobutane; 1,4-diazabicyclo[2.2.2]octane; 1,4-phenylenediamine; 1,6-diaminohexane; 2-(4-methoxyphenyl)-ethylamine; 2-aminobenzamide; 2-aminophenol; dipropylamine; triethylamine; tyramine; anthranilic acid; DL-2-aminobutyric acid; serine; threonine; tyrosine; adipic acid; methylenesuccinic acid; trans-propene-1,2,3-tricarboxylic acid; cyclohexanol; cyclohexanone; dimedone (5,5-dimethylcyclohexane-1,3-dione); N,N-dimethylcyclohexylamine; trans-1,2-cyclohexanediol; (4-hydroxyphenyl)acetic acid; 1,3,5-trihydroxybenzene; 2-ethylpyridine; 2-methoxybenzoic acid; 2-methoxyphenol; 2-methylhydroquinone; 2-methylresorcinol; 2,4-dihydroxybenzoic acid; 2,6-dihydroxybenzoic acid; 3-aminophenol; 3,4-dihydroxybenzoic acid; 3,5-dihydroxybenzoic acid; 4-amino-3-nitrophenol; 4-aminophenol; 4-hydroxybenzaldehyde; 4-hydroxybenzoic acid; 5-methylresorcinol; acetylsalicylic acid; salicylic acid and methyl, ethyl, propyl, benzyl esters; butylhydroxytoluene; N-phenyl-2,2'-iminodiethanol; N-phenylurea; methyl-, ethyl-, propyl-4-hydroxybenzoate; sulphanilic acid; vanillin; (2-ethoxyethyl)-acetate; (2-ethoxyethyl)-methacrylate; (2-hydroxypropoyl)-methacrylate; [2-(2-butoxyethoxy)-ethyl]-acetate; 1,2-propylene glycol diacetate; diethyl malonate; dimethyl acetylsuccinate; dimethyl carbonate; dimethyl fumarate; dimethyl glutarate; dimethyl malonate; ethyl acetate; ethylene glycol diacetate; ethyl formate; ethyl lactate; glycerol triacetate; isopropenyl acetate; methyl formate;

methyl lactate; methyl propionate; propyl formate; propyl propionate; tetraethyl orthocarbonate; triethyl citrate; 1-benzylpiperidin-4-one; 1-cyclohexyl-2-pyrrolidone; 1H-benzotriazole; 2-aminothiazole; 2-ethoxy-3,4-dihydro-2H-pyran; 2-ethylpiperidine; 2-mercapto-1-methylimidazole; 2-methyltetrahydrofuran; 2,2,6,6-tetramethyl-4-piperidinol; ascorbic acid; caffeine, theobromine, theophylline and the corresponding ethylxanthines; coumarin-3-carboxylic acid; ectoine; hydroxyproline; imidazole; indole; indole-3-acetic acid and its salts; melamine (2,4,6-triamino-1,3,5-triazine); methyl nicotinate; ethyl nicotinate, nicotinamide; nicotinic acid; pyridine-2-carboxylic acid; pyridine-2,3-dicarboxylic acid; pyridine-4-carboxylic acid; tropine (3-tropanol); tryptamine; nitroethane; nitromethane; 2-methyl-1-butanol; isobutanol (2-methyl-1-propanol); tert-amyl alcohol; 1,3-cyclopentanedione; 2,6-dihydroxyacetophenone; 3-methyl-3-penten-2-one; acetophenone; diethyl ketone; dihydroxyacetone; ethyl methyl ketone; isobutyl methyl ketone (methyl isobutyl ketone, MIBK); isopropyl methyl ketone; methyl propyl ketone; propiophenone; 2-butanoxim; sulphanilamide; 1,2,6-hexanetriol; 2-[4-(2-hydroxyethyl)-1-piperazinyl]-ethanesulphonic acid; 2-amino-2-methyl-1,3-propanediol (AEPD, ammediol), individually or as a mixture including their derivatives.

The NP-MCA is preferably contained in the composition according to aspects of the invention at a level of 1-80 wt.-% relative to the total weight of composition a), particularly preferably of 2-25 wt.-%, quite particularly preferably of 10-24 wt.-%.

For the purpose of the present invention, oils are meant by the at least one water-insoluble substance with a solubility in water of less than 4 g per liter. The term oil denotes all hydrophobic substances which do not mix homogeneously with water or a watery liquid and form a separate phase. As some oils still largely dissolve in water, a water solubility of less than 4 grams per liter is additionally defined here. Preferably, the water-insoluble substances are those with a water solubility of less than 2 g per liter. These include e.g. alkanes (benzines) and cycloalkanes (preferably cyclohexane). Aromatics such as toluene, xylenes or other alkyl benzenes as well as naphthalenes also come into consideration.

Long-chain alkanoic acid esters, such as fatty oils and fatty acid alkyl esters or fatty alcohol ethers are preferred. According to aspects of the invention, benzyl acetate also belongs to the water-insoluble substances used. However, terpenes, e.g. monocyclic monoterpenes with cyclohexane structure, can also be used. Here terpenes from citrus fruits, such as lemon and/or orange terpenes or the limonene contained therein are particularly preferred. The water-insoluble substances a) are preferably contained at a level of 0.1-90 wt.-% in the composition a) according to aspects of the invention, preferably of 0.5-75 wt.-%, particularly preferably of 1.0 to 50 wt.-%, quite particularly preferably of 1.5-30 wt.-% relative to the total weight of the composition according to aspects of the invention.

Higher alcohols for example can be used as further amphiphilic substances with surfactant structure. Particularly preferred here are above all cosurfactants with hydrophilic-lipophilic molecular proportions such as e.g. the n- and i-isomers of butanol, pentanol, hexanol, heptanol, octanol, nonanol, decanol, undecanol and dodecanol.

Cycloalkanols, such as cyclohexanol or particularly preferably phenyl alcohols such as phenyl methanol (benzyl alcohol), 2-phenylethanol and 3-phenyl-1-propanol are also preferred. Short-chain fatty acids, such as hexanoic, heptanoic, octanoic acids and their alkali or ammonium salts can also preferably be used. Their salts of ethanolamines are particularly preferred.

The further amphiphilic substances with surfactant structure are preferably contained at a level of from 2 to 45 wt.-% in the composition according to aspects of the invention, relative to the total weight of the composition according to aspects of the invention, particularly preferably from 2 to 40 wt.-%.

Particularly preferably, the further amphiphilic substance with surfactant structure has a water solubility of from 2 g to 128 g per liter and is selected from the group comprising $C_4$-$C_{12}$ alcohols, cycloalkanols, phenyl alcohols, short-chain fatty acids or their alkali or ammonium salts.

The composition according to aspects of the invention further comprises as component c) anionic, cationic, amphoteric and/or non-ionic surfactants. Some preferably suitable surfactants are named in the following list.

As anionic surfactants, e.g. alkali or ammonium salts of long-chain fatty acids, alkyl(benzene)sulphonates, paraffin sulphonates, bis(2-ethylhexyl)sulphosuccinate, alkyl sulphates, such as above all sodium dodecyl sulphate and, for specific applications which involve e.g. corrosion protection, sometimes also alkyl phosphates (e.g. Phospholan® PE 65, Akzo Nobel) can be used.

As non-ionic surfactants, polyalkylene oxide-modified fatty alcohols, such as e.g. Berol® types (Akzo Nobel) and Hoesch T types (Julius Hoesch), as well as also corresponding octylphenols (Triton types) or nonylphenols, can be used. A particular field of use is made possible by the heptamethyltrisiloxanes (e.g. Silwet® types, GE Silicones), as agents for greatly increasing the spraying properties of the liquids or for significantly lowering the interfacial tension.

As cationic surfactants, e.g. coco bis(2-hydroxyethyl-) methylammonium chloride or polyoxyethylene-modified talc methyl-ammonium chloride can be used. In addition, the use of suitable amphoteric surfactants is also possible, of which just betaines (cocoamidopropyl betaine) or sulphobetaines or sultaines (amidopropylhydroxysultaines) may be named by way of example from the known plurality. If a further pH range is to be covered, the coco dimethylamine oxide (Aromox® MCD, Akzo Nobel) has proved to be suitable.

The surfactants are contained in the composition according to aspects of the invention at a level of between 0.1 and 45 wt.-%, preferably between 1.0 and 30 wt.-%, quite preferably from 9.0 to 16.0 wt.-%, relative to the total weight of the composition according to aspects of the invention.

In addition, the invention relates to a method for producing the composition according to aspects of the invention. The method according to aspects of the invention for producing a composition according to aspects of the invention can be carried out by introducing at least one polar solvent in particular with hydroxy functionality, preferably in a quantity of between 1.0 and 90 wt.-%, relative to the complete composition, and dissolving an anionic, cationic, amphoteric and/or non-ionic surfactant, preferably in a quantity of from 0.1 to 45 wt.-%, relative to the complete composition, in this at 10 to 90° C. accompanied by stirring, adding water-insoluble substance(s), preferably in a quantity of from 0.1 to 90 wt.-%, relative to the complete composition, parallel to or after addition of surfactant and then converting the emulsion that has formed to an optically transparent enlarged microemulsion or a nanophase system by adding a further amphiphilic substance with surfactant structure and NP-MCA, preferably in a quantity of from 0.1 to 80 wt.-%, relative to the complete composition, and optionally adding excipients at the end of the mixing procedure.

The composition according to aspects of the invention is produced in particular by first introducing water or the solvent with hydroxy functionality into a suitable vessel and then dissolving the surfactant accompanied by stirring. In the process it is to be borne in mind that some surfactants may already contain water as supplied, with the result that the quantity of water precalculated in the formulation must be adjusted where necessary. When dissolving the surfactant, it must be ensured that the input of air into the solution is kept as small as possible in order to avoid excessive foaming. For industrial-scale implementation, there are already many variations of stirring units and stirrers for largely avoiding foaming. The stirring speed should not usually exceed 200 revolutions per minute when using propeller mixers and ideal ratios of stirrer diameter and container diameter. In addition, it must be borne in mind that some (concentrated) surfactants may form gels when water is added, which can make stirring and a further dispersion difficult. In such cases, the water-insoluble substances (oil phase) must, where necessary, be added first or parallel to the addition of surfactant. Foaming can also be prevented by subsequently adding the oil phase, as this often has a certain anti-foam action. After addition of the oil phase, a milky, cloudy emulsion has formed which clears due to the addition of the further amphiphilic substance with surfactant structure (for example alkanol), but at the latest after addition of the amphiphile without surfactant structure according to component b) (for example an acetoacetate compound) and finally passes into an optically transparent enlarged microemulsion or a nanophase system. At the end, excipients and additives, such as for example thickeners (for example those from the group of the Aerosils) can also be added.

A subject of the invention is also a method for producing the composition according to aspects of the invention, according to which i) at least one polar solvent in particular with hydroxy functionality is introduced, ii) an anionic, cationic, amphoteric and/or non-ionic surfactant is dissolved in this at 10 to 90° C. accompanied by stirring, iii) water-insoluble substance(s) are added parallel to or after addition of surfactant and iv) the emulsion that has formed is then converted to an optically transparent nanophase system by adding at least one NP-MCA and v) at the end of the preceding mixing procedure excipients are optionally added.

Preferably, at least one further amphiphilic substance with surfactant structure, for example a cosurfactant with hydrophilic-lipophilic molecular proportions, can be added to this mixture, in particular between the method steps i) and iv), preferably between the method steps ii) and iv).

The present invention also includes as a subject a method for producing a composition suitable for the wet cleaning of objects, in particular their surfaces, made of organic or inorganic materials, according to which i) at least one polar protic solvent, in particular with hydroxy functionality, is introduced, preferably in a quantity of between 1.0 and 90 wt.-%, relative to the complete composition, ii) an anionic, cationic, amphoteric and/or non-ionic surfactant, preferably in a quantity of from 0.1 to 45 wt.-%, relative to the complete composition, is then dissolved in i) at 10 to 90° C. accompanied by stirring, iii) water-insoluble substance(s) are added, preferably in a quantity of from 0.1 to 90 wt.-%, relative to the complete composition, parallel to or after addition of surfactant according to step ii), iv) the emulsion that has formed is then converted to an optically transparent nanophase system by adding at least one amphiphilic substance NP-MCA, preferably in a quantity of from 0.1 to 80 wt.-%, relative to the complete composition, v) at the end of the mixing procedure comprising steps i) to iv) excipients are optionally added.

A subject of the present invention is also a composition, which can be produced using one of the above-described methods, for the wet cleaning of surfaces of objects made of organic or inorganic materials.

Also a subject of the present invention is a method for producing a gas or gas bubbles for cleaning surfaces of objects made of organic or inorganic materials in liquids which is characterized in that a composition according to aspects of the invention is brought into contact with an object to be cleaned.

A subject of the present invention likewise lies in the use of a composition according to aspects of the invention for cleaning objects, in particular their surfaces, made of organic or inorganic materials.

Moreover, a further subject of the present invention consists in the use of a gas or gas bubbles, which are formed from a composition according to aspects of the invention or can be produced by an above-described method for producing said composition, for the wet cleaning of objects, in particular their surfaces, made of organic or inorganic materials.

A further subject of the present invention is the use of a composition according to aspects of the invention for producing a gas or gas bubbles for the wet cleaning of objects, in particular their surfaces, made of organic or inorganic materials.

The applications of the composition according to aspects of the invention include all methods known per se which are usual in the cleaning of objects.

Such methods can include applications such as for example depositing, bathing, immersing, painting, spraying, dabbing or wetting.

All solid materials known per se which require cleaning come into consideration as inorganic or organic materials, without limitation as to their size, origin, condition and/or shape.

In particular, according to aspects of the invention, those inorganic or organic materials can be advantageously cleaned for which a cleaning using previous methods was problematical because of structural or design-related factors and/or where the dirt particles have stuck particularly stubbornly, for example in pores, folds and corners, which can be the case for example as a result of abrasion, dusts or pigment particles.

The following can be named for this by way of example, but not exhaustively: building fabric, facades, paving slabs, artificial and natural stones and items shaped from this, such as for example objets d'art, sculptures, vases, troughs, climbing holds (projections consisting of artificial or natural stone material, attached to climbing walls), items made of polymers and metals, comprising drilling and grinding tools or implements, gears and parts thereof, bearings, rollers, in particular printer rollers, machines and parts thereof, casings and parts thereof, chassis, gear wheels, instruments for medical and dental use, visual or auditory aids or an object used in medicine or diagnostics in the medical or dental field, denture parts and parts for corrective dentistry, such as for example dentures, prostheses, dental bridges and dental braces, woven fabrics, fibres, electronic components, such as for example semiconductors and circuit boards.

The composition according to aspects of the invention can advantageously be present in a packaging unit as a kit-of-parts, comprising, in a spatially separated manner but in functional combination, a composition according to the present invention and an item provided for the cleaning method or one that can be used for it.

The item that can be used for the cleaning can additionally be present in the kit-of-parts together with one or more aids useful for the cleaning, for example selected from tweezers, pen, brushes, pads, devices for pump-action sprays, nozzles or eye protection alone or in combination.

The already-mentioned kit-of-parts can therefore comprise at least one such aid alone or together with an above-mentioned item.

The method according to aspects of the invention can be carried out according to usual methods and using the usual applications and aids, as has been listed by way of example.

Depending on the nature and the degree of the dirt as well as depending on the size, shape and the condition of the object to be cleaned, a person skilled in the art can ascertain, by routine tests, which of the disclosed procedures he will prefer and within what time the desired result occurs.

The duration of the exposure of the object to be cleaned to the composition according to aspects of the invention is not critical. In general, it can be assumed that the period for which the object is exposed to the composition, or for which they are left in contact, can be between a few minutes and several weeks, preferably not less than 24 hours. The result of the cleaning will show a person skilled in the art, for example by simple observation or by utilization of visual means, such as for example a magnifying glass or a microscope, when he can remove the composition from the object or when he can conclude the cleaning method.

The item provided for the cleaning method can comprise in particular objects for daily use which need ongoing or occasional cleaning. For example, artificial dentures, prostheses, bridges or dental braces, tools for medical or diagnostic use, can advantageously be present as a kit-of-parts together with the composition according to aspects of the invention.

An agent or a pack comprising a kit-of-parts, containing a composition according to aspects of the invention spatially or physically separated in functional combination with an item suitable for the cleaning or to be used for this and/or an aid as defined above, is also a subject of the present invention.

The following examples are intended to explain the invention in still more detail, without limiting it to same in any way.

Example 1

Gas-Forming Composition

| Component | Quantity (wt.-%) |
|---|---|
| Water | 57.00 |
| Citric acid monohydrate[1)] | 0.40 |
| Ethyl acetoacetate[2)] | 13.95 |
| Orange terpenes[3)] | 11.00 |
| Berol 260[4)] | 8.85 |
| Sodium dodecyl sulphate[5)] | 8.80 |
| | 100.00 |

[1)]VWR International GmbH, Dresden, Germany,
[2)]Fluka Sigma-Aldrich Chemie GmbH, Taufkirchen, Germany,
[3)]Weissmeer-Baltische, Hamburg, Germany,
[4)]Hoesch GmbH & Co. KG, Düren, Germany,
[5)]EMAL 10P HD: P.T. Kao Indonesia Chemicals via Biesterfeld Spezialchemie GmbH, LifeScience, Hamburg, Germany.

The given quantity of demineralized water was introduced into a screw-lid glass with magnetic stir bar at room temperature (22° C.). The given quantities of citric acid monohydrate, ethyl acetoacetate, orange terpenes, Berol 260 and sodium dodecyl sulphate (SDS) were added to this. The mixture was stirred at room temperature on an MR Hei-Standard magnetic stirrer from Heidolph (Heidolph Instruments GmbH & Co. KG, Schwabach, Germany) at maximum speed (1400 rpm) until there was a single phase.

It was ensured that the SDS was added carefully accompanied by stirring and stirring continued until there was a single phase. With larger batches of from 5 kg upwards, it is advantageous to provide sodium dodecyl sulphate and to pre-suspend it in all other components except for water. The water portion is preferably added at the end.

The composition from Example 1 forms carbon dioxide as gas.

Example 2

Gas-Forming Composition

| Component | Quantity (wt.-%) |
|---|---|
| Water | 57.00 |
| Oxalic acid dihydrate[6)] | 0.40 |
| Ethyl acetoacetate | 13.95 |
| Orange terpenes | 11.00 |
| Berol 260 | 8.85 |
| Sodium dodecyl sulphate | 8.80 |
| | 100.00 |

[6)]VWR International GmbH, Dresden, Germany,

The given quantities of demineralized water, oxalic acid dihydrate, ethyl acetoacetate, orange terpenes, Berol 260 and sodium dodecyl sulphate (SDS) were mixed as indicated under Example 1.

The composition from Example 2 forms carbon dioxide as gas.

Example 3

Gas-Forming Composition

| Component | Quantity (wt.-%) |
|---|---|
| Water | 20.96 |
| Triethyl phosphate[7)] | 5.13 |
| Ethyl acetoacetate | 18.32 |
| n-butyl acetate[8)] | 8.41 |
| 1-hexanol[9)] | 10.45 |
| Benzyl acetate[9)] | 10.45 |
| Orange terpenes | 10.60 |
| Citric acid monohydrate | 0.40 |
| Berol 260 | 2.14 |
| Sodium dodecyl sulphate | 13.14 |
| | 100.00 |

[7)]Kurt Obermeier GmbH & Co. KG, Bad Berleburg, Germany
[8)]Hoesch GmbH, Düren, Germany
[9)]SAFC, Sigma-Aldrich Chemie GmbH, Taufkirchen, Germany The given quantities of demineralized water, triethyl phosphate, ethyl acetoacetate, n-butyl acetate, 1-hexanol, benzyl acetate, orange terpenes, citric acid monohydrate, Berol 260 and sodium dodecyl sulphate (SDS) were mixed as indicated under Example 1. The composition from Example 3 forms carbon dioxide as gas.

Example 4

Gas-Forming Composition

| Component | Quantity (wt.-%) |
|---|---|
| Water | 20.23 |
| Triethyl phosphate | 4.96 |
| Ethyl acetoacetate | 17.68 |
| n-butyl acetate | 8.12 |
| 1-hexanol | 10.12 |
| Benzyl acetate | 10.12 |
| Orange terpenes | 10.22 |
| Citric acid monohydrate | 3.85 |
| Berol 260 | 2.04 |
| Sodium dodecyl sulphate | 12.66 |
| | 100.00 |

The given quantities of demineralized water, triethyl phosphate, ethyl acetoacetate, n-butyl acetate, 1-hexanol, benzyl acetate, orange terpenes, citric acid monohydrate, Berol 260 and sodium dodecyl sulphate (SDS) were mixed as indicated under Example 1. The composition from Example 4 forms carbon dioxide as gas.

Example 5

Gas-Forming Composition

| Component | Quantity (wt.-%) |
|---|---|
| Water | 18.30 |
| Triethyl phosphate | 4.48 |
| Ethyl acetoacetate | 15.99 |
| n-butyl acetate | 7.35 |
| 1-hexanol | 9.15 |
| Benzyl acetate | 9.15 |
| Orange terpenes | 9.24 |
| Oxalic acid dihydrate | 13.04 |
| Berol 260 | 1.85 |
| Sodium dodecyl sulphate | 11.45 |
| | 100.00 |

The given quantities of demineralized water, triethyl phosphate, ethyl acetoacetate, n-butyl acetate, 1-hexanol, benzyl acetate, orange terpenes, oxalic acid dihydrate, Berol 260 and sodium dodecyl sulphate (SDS) were mixed as indicated under Example 1. The composition from Example 5 forms carbon dioxide as gas.

Example 6

Gas-Forming Composition

| Component | Quantity (wt.-%) |
|---|---|
| Water | 18.82 |
| Diacetone alcohol[10)] | 4.29 |
| Ethyl acetoacetate | 42.42 |
| Orange terpenes | 4.18 |

-continued

| Component | Quantity (wt.-%) |
|---|---|
| Oxalic acid dihydrate | 0.40 |
| Berol 260 | 26.89 |
| Sodium dodecyl sulphate | 3.00 |
| | 100.00 |

[10)]Applichem GmbH, Darmstadt, Germany

The given quantities of demineralized water, diacetone alcohol, ethyl acetoacetate, orange terpenes, Berol 260, oxalic acid dihydrate and sodium dodecyl sulphate (SDS) were mixed as indicated under Example 1.

The composition from Example 6 forms carbon dioxide as gas.

Example 7

Gas-Forming Composition

| Component | Quantity (wt.-%) |
|---|---|
| Water | 57.05 |
| N-acetylcysteine[11)] | 4.08 |
| Cetiol OE[12)] | 15.28 |
| Triethyl citrate[13)] | 5.09 |
| Lutensol TO 3[14)] | 11.84 |
| Tween 80[11)] | 6.66 |
| | 100.00 |

[11)]Applichem GmbH, Darmstadt, Germany
[12)]KMF, VWR International GmbH, Dresden, Germany
[13)]Cognis GmbH, Düsseldorf, Germany
[14)]BASF SE, Ludwigshafen, Germany The given quantities of demineralized water, N-acetylcysteine, Cetiol OE, triethyl citrate, Lutensol TO 3, and Tween 80 were mixed as indicated under Example 1.

The composition from Example 7 forms hydrogen sulphide as gas.

Example 8

Gas-Forming Composition

| Component | Quantity (wt.-%) |
|---|---|
| Water | 57.00 |
| Ammonium peroxodisulphate[15)] | 0.40 |
| Ethyl acetoacetate | 13.95 |
| Orange terpenes | 11.00 |
| Berol 260 | 8.85 |
| Sodium dodecyl sulphate | 8.80 |
| | 100.00 |

[15)]Merck KGaA, Darmstadt, Germany

The given quantities of demineralized water, ammonium peroxodisulphate, ethyl acetoacetate, orange terpenes, Berol 260 and sodium dodecyl sulphate (SDS) were mixed as indicated under Example 1.

The composition from Example 8 forms oxygen as gas.

Example 9

Cleaning of the Surface of an Organic Material

A composition according to Example 2 was applied at room temperature (22° C.) to a dirty climbing hold made of cross-linked synthetic resin with microporous surface. The climbing hold had been previously attached as an artificial projection to sports climbing walls and had been made very dirty as a result of being worn by feet or shoes and perspiration. After the composition had been allowed to act for 2 hours, gas bubbles formed at the dirty points. During this process, the dirt particles were removed from the surface of the climbing hold. After the action time, the climbing hold was washed down with water. Dirt was removed from the surface by the procedure, leaving behind a very clean impression. The subsequent microscopic examination revealed that the pores of the climbing hold now contained virtually no dirt.

In a control test and an analogous application to a comparably dirty climbing hold with a commercial cleaning agent of the trade mark Domax®, plastic cleaner (domalwittol, Wasch- and Reinigungsmittel GmbH Stadtilm, Germany) which contained anionic and non-ionic surfactants, preservatives and fragrances did not result in a comparable cleaning effect.

Example 10

Detection of the Fluid Nanophase Systems

Green laser-beam scatter experiments (Conrad Electronic, Germany, Model No. GLP-101, 530-545 nm) for detecting the nanostructuring in nanophase systems. The results are shown in FIG. 1, to which reference is made (the given percentages by weight are relative to the respective complete composition):

a) fluid nanophase system according to aspects of the invention of the following composition: water 57.00 wt.-%; oxalic acid dihydrate 0.40 wt.-%; ethyl acetoacetate 13.95 wt.-%; orange oil (ex *Citrus dulcis*) 11.00 wt.-%; $C_{9-11}$ alcohol ethoxylate (4) (Berol 260) 8.85 wt.-%; sodium dodecyl sulphate 8.80 wt.-%. A gas formation occurs which is to be recognized by bubbles that form. The green laser beam is visible due to scattering, in other words the liquid is nanostructured.

b) fluid nanophase system of the following composition: water 55.28 wt.-%; 1-methyl-2-pyrrolidone 3.47 wt.-%; ethyl acetoacetate 12.28 wt.-%; orange oil (ex *Citrus dulcis*) 11.35 wt.-%; $C_{9-11}$ alcohol ethoxylate (4) (Berol 260) 8.82 wt.-%; sodium dodecyl sulphate 8.80 wt.-%. The green laser beam is visible due to scattering, in other words the liquid is nanostructured. A gas formation does not take place in this system. A red laser beam is barely scattered in the nanophase systems, as here the wavelength of the red light is too large for an interaction.

c) water; the laser is not visible.

The invention claimed is:

1. A method for cleaning objects made of organic or inorganic materials comprising the steps of:

A) bringing an object made of organic or inorganic materials into contact with a composition in the form of a fluid nanophase system comprising the components a) at least one water-insoluble substance with a water solubility of less than 4 grams per liter, in a quantity of from 0.1 to 90 wt.-%, b) at least one mixed-chain amphiphilic substance NP-MCA, which does not have a surfactant structure and is not micelle-structure-forming on its own, which has a solubility in water or oil that is between 4 g and 1000 g per liter and which does not accumulate at an oil-water interface, in a quantity of from 0.1 to 80 wt.-%, c) at least one anionic, cationic, amphoteric and/or nonionic surfactant; in a quantity of from 0.1 to 45 wt.-%, d) water in a quantity of between 1.0 and 90 wt.-%, e) optionally one or more excipients, in a quantity of from 0.01 to 10 wt.-%, wherein each percentage is based on a total weight of the composition, and wherein the NP-MCA is selected from acetoacetates of Formula II:

C(R3)3-CO—CH2-CO—O—R4 [Formula II]

wherein in each case independently of each other R3 is hydrogen or a C1 to C2 alkyl and R4 is a branched or unbranched C1 to C4 alkyl;

or acetoacetates of Formula III:

CH3-CO—CH2-CO—O—R5 [Formula III]

wherein R5 is a C1 to C4 alkyl;

B) leaving the composition from step A) in contact with the object until gas or gas bubbles form on the object, C) removing the composition from step A) from the object and D) optionally then rinsing and/or drying the object treated by steps A) and B).

2. The method according to claim 1, wherein the composition contains at least one further amphiphilic substance.

3. The method according to claim 1, wherein the amphiphilic substance NP-MCA is selected from ethyl acetoacetate, iso-propyl acetoacetate, methyl acetoacetate, n-butyl acetoacetate, n-propyl acetoacetate or tert-butyl acetoacetate.

4. The method according to claim 1, wherein the amphiphilic substance NP-MCA is contained at a level of between 2 and 25 wt.-%, based on the total weight of the composition.

5. The method according to claim 1, wherein the gas or the gas bubbles comprise carbon dioxide, hydrogen, nitrogen, oxygen, chloride, nitrogen oxides, ammonia, halogenated hydrocarbons or hydrogen sulphide, or a mixture thereof.

6. The method according to claim 2, wherein the amphiphilic substance is selected from the groups consisting of a) diols of Formula I:

$R_1R_2COH—(CH_2)_n—COHR_1R_2$ [Formula I]

wherein n can be =0, 1, 2, 3 or 4, $R_1$ and $R_2$ are in each case independently of each other hydrogen or an unbranched or branched $C_1$-$C_3$ alkyl, b) diones of Formula IV $CH_3—(CH_2)p\text{-}CO—(CH_2)q\text{-}CO—(CH_2)r\text{-}CH_3$ [Formula IV]

wherein p, q, r independently of each other can be 0, 1 or 2, with the proviso that, when p+q+r=2, the compound according to Formula IV can also be cyclic;

c) esters of Formula V $R_6—CO—O—R_7$ [Formula V]

wherein $R_6$ is a ring bond to $R_7$, $CH_3$ or $COCH_3$ and $R_7$ is $(CH_2)_2$—O-ring bond to $R_6$, $(CH_2)_2—O—(CH_2)_3—CH_3$, $CH_2—CH_3$ or $CH_2—CH(CH_3)$—O-ring bond to $R_6$, d) maleic or fumaric acid amides of Formula VI $R_8—HN—CO—C{=}C—CO—O—R_9$ [Formula VI]

wherein $R_8$ is hydrogen, a branched or unbranched $C_1$-$C_4$ alkyl, or a branched or unbranched, linear or cyclic $C_1$-$C_6$ alkyl, wherein the $C_1$-$C_6$ alkyl is substituted by one or more groups selected from OH, $NH_2$, COOH, CO, $SO_3H$, $OP(OH)_2$, and $R_9$ is hydrogen or a branched or unbranched $C_1$-$C_4$ alkyl.

* * * * *